United States Patent [19]

Haaheim

[11] Patent Number: 4,529,194

[45] Date of Patent: Jul. 16, 1985

[54] CARDIOVASCULAR EXERCISE MACHINE

[76] Inventor: Gary Haaheim, 12 Haverhill Rd., Chaska, Minn. 55318

[21] Appl. No.: 485,874

[22] Filed: Apr. 18, 1983

[51] Int. Cl.[3] ..... A63B 69/18

[52] U.S. Cl. ..... 272/69; 272/70; 272/97; 272/132

[58] Field of Search ..... 272/69, 70, 70.3, 126, 272/97, 144, 131–133; 434/255; 128/25 R; 188/83, 84, 65.1, 65.5, 184

[56] References Cited

U.S. PATENT DOCUMENTS

| | | | |
|---|---|---|---|
| 518,967 | 5/1894 | Poole | 272/132 |
| 2,772,881 | 12/1956 | Fundom | 272/70 |
| 3,659,842 | 5/1972 | Aijala | 272/97 |
| 4,342,452 | 8/1982 | Summa | 272/69 |
| 4,402,506 | 9/1983 | Jones | 272/70 |
| 4,406,451 | 9/1983 | Gaetano | 272/69 |
| 4,434,981 | 3/1984 | Norton | 272/70 |

FOREIGN PATENT DOCUMENTS

| | | | |
|---|---|---|---|
| 2631897 | 1/1978 | Fed. Rep. of Germany | 272/97 |
| 2007987 | 5/1979 | United Kingdom | 272/70 |

OTHER PUBLICATIONS

Nordic Track—Edward Pauls, The Washington Star/-Mar. 30, 1980 p. 23.

*Primary Examiner*—Richard J. Apley
*Assistant Examiner*—S. R. Crow
*Attorney, Agent, or Firm*—Malcolm Reid

[57] ABSTRACT

A cardiovascular exercise machine used for simulating the motions of cross-country skiing including a means for providing arm and leg resistance in the forward as well as the backward direction, thereby allowing the user of the exercise machine to achieve a higher heart rate more easily than is achievable with cross-country skiing or other exercise machines. The apparatus includes a frame; two skates cabled together for rolling movement on separate tracks with a means for providing drag on the cable, the skates, tracks and drag means being mounted on the frame; and two pole carriage assemblies having floating brakes which provide frictional engagement during travel along opposed side rails.

8 Claims, 14 Drawing Figures

CARDIOVASCULAR EXERCISE MACHINE

BACKGROUND OF THE INVENTION

1. Field of the Invention

The present invention relates to an exerciser used for elevating the user's heart rate by requiring the user to simulate the motions used during cross-country skiing with the added element that there is arm and leg resistance in the foward as well as the backward direction.

2. Description of the Prior Art

The prior art U.S. Pat. No. 4,023,795, issued by the U.S. Patent Office on May 17, 1977 to Edward A. Pauls, discloses a ski exerciser used for simulating the motions required in cross-country skiing. The system used to simulate the cross-country skiing motions employs a complicated system comprised of a flywheel with a brake band engaging the periphery of the flywheel to provide the drag which the user must work against. Additionally, it discloses the use of two drive roller assemblies mounted on the same shaft as the flywheel but on opposed sides of the flywheel, each drive roller assembly including a one way clutch. The cross-country skiing simulator of U.S. Pat. No. 4,023,795 requires the user to employ his own cross-country skiis for use in conjunction with the skiing simulator. The ski pole simulators are similarily a separate and detached part of the disclosed cross-country ski simulator. The cross-country ski simulator of U.S. Pat. No. 4,023,795 does not provide a restraint to arrest the inadvertant backward fall of the user.

SUMMARY OF THE INVENTION

The present invention is a cardiovascular exercise machine which simulates the motions and forces that are present in cross-country skiing with the addition that there is arm and leg resistance in the forward direction as well as in the backward direction. In cross-country skiing the user pushes backward on one of his skis to thrust his body forward. Once the user's body is thrust forward, there is no force required of the user to continue in the forward motion until the skis gradually come to a halt or slow down to a point that the user wishes to exert backward thrust on the alternate ski to continue the forward glide. Likewise, the skier provides additional forward thrust by pushing backward on his ski poles, alternating from one ski pole to the other. Since the present invention's purpose is to provide the maximum amount of exercise so that the user's heart rate can reach a target zone which is defined as seventy to eighty-five percent of the maximum heart rate obtainable, rather than to simply simulate cross-country ski motions, arm and leg resistance in the forward direction is provided. It is commonly accepted that cardiovascular exercise to be effective must be a continuous and vigorous exercise which brings the heart rate in the target zone. The benefits of cardiovascular exercise are well documented. It is generally accepted that cross-country skiing is the best cardiovascular sport. The cardiovascular exercise machine of the present invention is a device designed to incorporate all of the benefits of cross-country skiing to the cardiovascular system and to go beyond what is provided by cross-country skiing by providing the user with a work load in the forward direction. The cardiovascular exercise machine of the present invention is designed for the primary purpose of exercising the cardiovascular system as opposed to simply simulating a cross-country skiing experience indoors for those who wish to train in that sport specifically.

The exercise machine of the present invention consists of a frame on which are two track assemblies. Two cushioned skate assemblies are placed upon each of the track assemblies. Each skate assembly has roller bearings which ride on the track assemblies so that each skate can roll forward and backward along the track. A cable runs lengthwise along the center line of each track. The cable passes through two pulleys at the rear of the frame and two pulleys at the forward end of the frame. The cable passes through an adjustable drag assembly which exerts drag on the cable. Each skate is affixed to the cable so that the skates are opposite one another at approximately the longitudinal center of the frame.

Two vertical poles extend upwards from each side of the front of the frame. Two vertical poles extend upward from each side of the rear of the frame also. The vertical poles at the rear are shorter than the vertical poles at the front. Attached between the front and rear vertical poles are the side rails on each of which ride a pole carriage assembly with a brake which provides frictional engagement during travel along the side rail. The user stands on the skates and moves the skates along the tracks in a manner similar to the movement of the legs during cross-country skiing. To increase the work which the user must expend to move his legs back and forth, the drag assembly is adjusted to produce additional drag on the cable as it passes through the drag assembly. As the user moves his legs back and forth he is standing between the vertical poles and side rails while holding onto the pole carriage assemblies on either side of him. The pole carriage assemblies are moved back and forth along the side rails as one would move his ski poles during cross-country skiing. To increase the user's workload, the drag on the pole carriage assemblies can be increased so that it requires the user to exert more work to slide the pole carriage assemblies along the side rails.

DESCRIPTION OF THE PREFERRED EMBODIMENT

Figure 1:
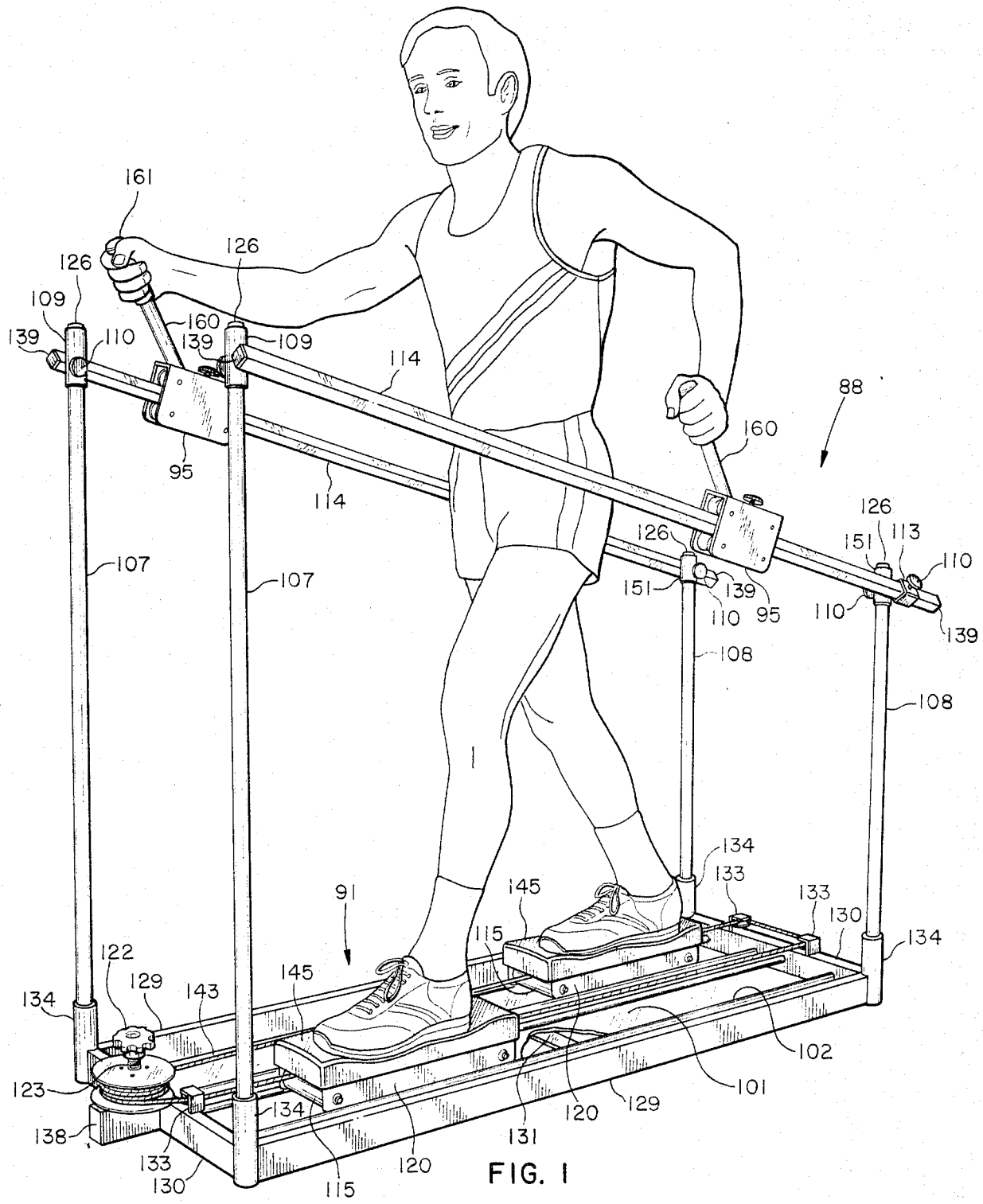
FIG. 1 is a perspective view of the cardiovascular exercise machine.

Referring first to FIG. 1 there is shown generally a cardiovascular exercise machine 88 of the present invention. The cardiovascular exercise machine 88 comprises a frame 91, two skate assemblies 94, a drag assembly 96, two track assemblies 92, two pole carriage assemblies 95, each of which are movably mounted on a side rail 114, the side rail 114 being supported above the frame 91 a distance which will allow a person standing on the skate assemblies 94 to comfortably grasp the pole handles 160. The skate assemblies 94 are fixedly interconnected to a cable 143 which follows a path from the drag assembly 96 along both longitudinal center lines of each of the track assemblies 92 in a closed circuit fashion.

Having given a short overall description of the preferred embodiment, I will now describe each main part of the cardiovascular exercise machine 88 under a separate heading.

Frame

Figure 8:
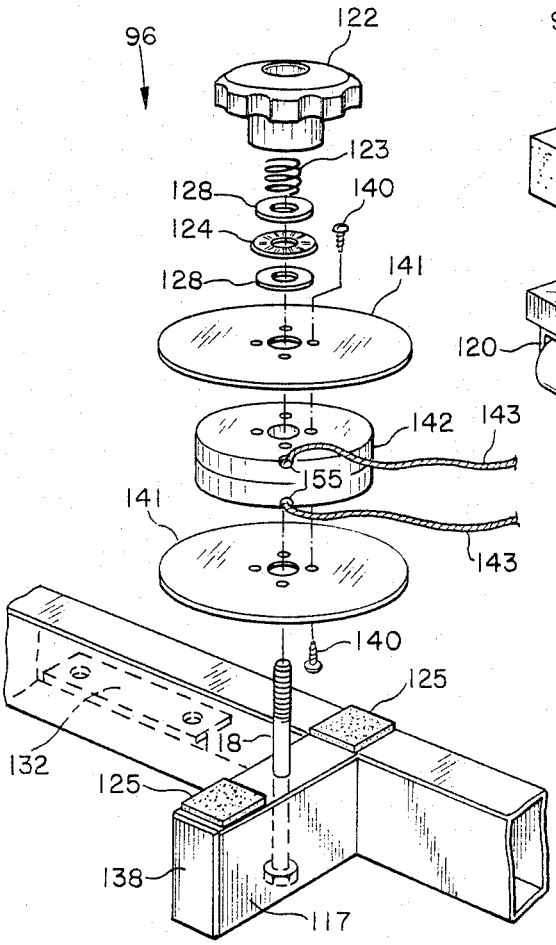
FIG. 8 is an exploded view of the drag assembly.
Figure 9:
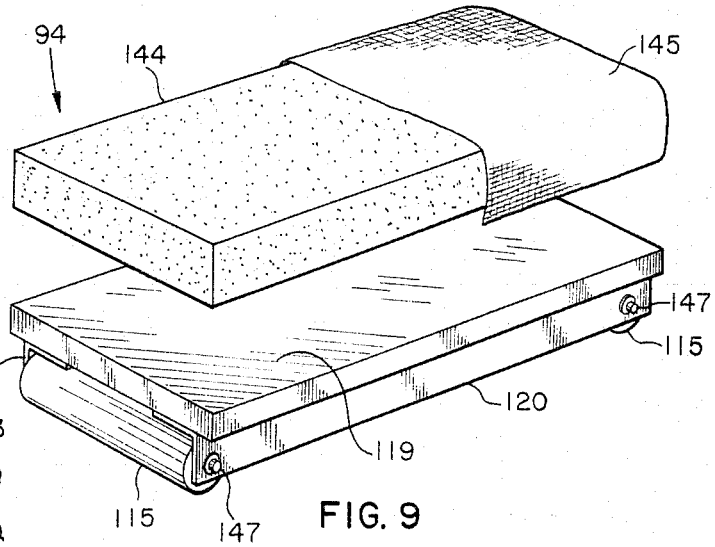
FIG. 9 is an exploded view of a skate assembly.
Figure 10:
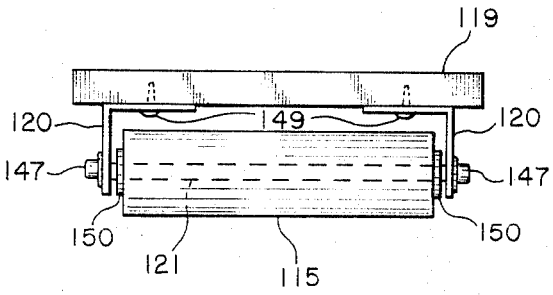
FIG. 10 is an end of a skate assembly without a foam pad or pad cover.
Figure 11:
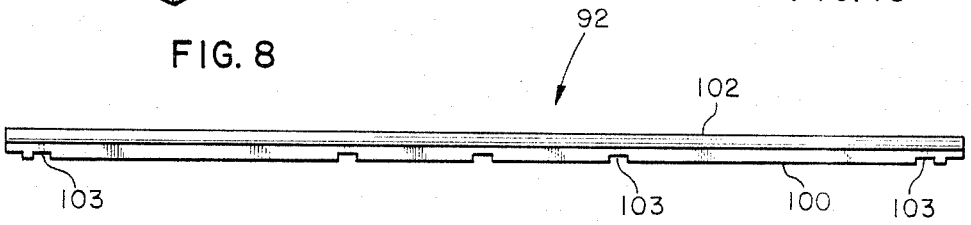
FIG. 11 is a side elevational view of a track assembly.
Figure 12:
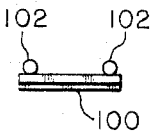
FIG. 12 is an end elevational view of a track assembly.
Figure 13:
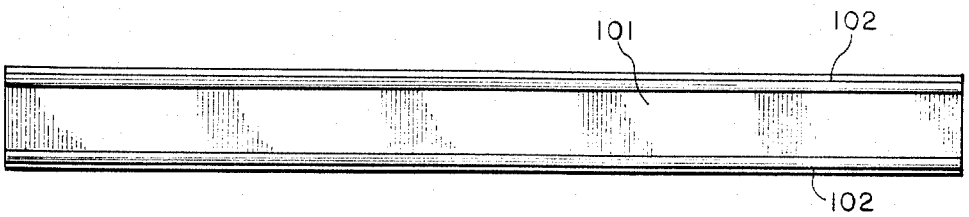
FIG. 13 is a top plan view of a track assembly.
Figure 14:
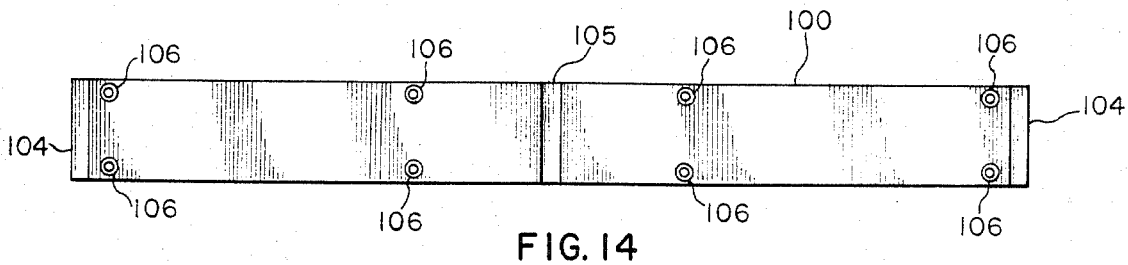
FIG. 14 is a bottom plan view of a track assembly.

The frame 91 is rectangular in shape. It is long enough to accommodate the stride of the largest person. The frame 91 consists of two end members 130 and two side members 129 fabricated out of hollow rectangular tubular steel which has been nickel-chrome plated. At each of the four junctions between a frame side 129 and a frame end member 130, a frame upright tube 134 is welded in place. The frame upright tube 134 is a hollow steel tube with a closed end on the bottom and an open end on the top. It is of such an inside diameter that it accommodates the insertion of the front vertical poles 107 and the rear vertical poles 108. At the longitudinal center of frame 91, the frame middle brace 131 is attached transversely to the frame sides 129. The frame middle brace 131 provides rigidity to the entire frame 91 and in particular to the frame sides 129. The frame middle brace 131 also provides a fastening point for each of the track assemblies 92. Four frame track supports 132 are affixed to frame ends 130. Two frame track supports 132 are affixed to the frame front end 130 and two are affixed to the frame rear end 130. They are affixed at the bottom of the frame end members 130 as shown in FIG. 8. Each frame track support 132 is affixed to the frame end 130 in line with the track assembly 92. The purpose of the frame track supports 132 is to provide a fastening point for the front and rear of each of the track assemblies 92. At the center of the front frame end 130 extending outwardly from frame 91, is drag assembly mounting stub 117. The drag assembly mounting stub 117 is made of the same type of material as are the sides 129 of the frame 91. The drag assembly mounting stub 117 provides a convenient mounting point for the drag assembly 96.

Track Assembly

The track assembly 92 is primarily shown in FIGS. 11 through 14. It consists of a wooden track 100 on which is mounted a neoprene track 101 along its full length. Track tubes 102 are mounted the full length of the track assembly 92 by track rivets 103 through rivet holes 106. The track tubes 102 provide guideways between which the skate assemblies 94 move. The track assemblies 92 are mounted on the frame 91 longitudinally and parallel to the frame sides 129 and at a fixed pre-determined distance between each track assembly 92. The predetermined distance is a distance which is comfortable for a person who is moving his legs back and forth and which allows back and forth movement of the legs without contact between the legs. The neoprene track 101 provides for almost noiseless operation when the skate wheel 115 of the skate assembly 94 moves over the surface of the neoprene track 101. It also, in conjunction with skate wheel 115, provides for a smooth rolling surface.

Skate Assembly

The basic building blocks of the skate assembly are the skate wheel brackets 120. The skate wheel brackets 120 are connected together by the skate board 119 which forms a mounting surface for the foam pad 144 which is covered by the pad cover 145. The skate wheel brackets 120 run lengthwise along skate board 119. The skate wheel brackets 120 are fabricated of 90° angle metal of either aluminum or steel. The top of the angle is fastened to the bottom of the skate board 119. The side of the angle supports a skate wheel 115 between the two skate wheel brackets 120. The skate assembly 94 is fitted with two skate wheels 115, one at each end of the skate assembly 94. The skate wheels 115 are mounted between the skate wheel brackets 120 on an axle 121 which extends through the sides of the opposed skate wheel brackets 120 and the center of the skate wheel 115. Between the skate wheel bracket 120 and the ends of the skate wheels 115, washers 150 are placed. These washers 150 are of a ultra high molecular weight plastic nylon variety and provide spacing between the insides of the skate wheel brackets 120 and the ends of the skate wheels 115 so that the full surface of the skate wheels 115 do not engage the skate wheel brackets 120. The washers 150 thereby increase the smooth gliding flow of the skate assembly 94. The skate wheel 115 itself is made of a wear resistant ultra high molecular weight plastic. As the almost frictionless ultra high molecular weight plastic skate wheel 115 rolls on the neoprene track 101, the movement is smooth, almost frictionless, and relatively quiet. Each skate wheel axle 121 is held in place by end caps 147 placed on both ends of each axle 21. The skate board 119 is affixed to the skate wheel brackets 120 by wood screws 149. The skate wheel 115 is mounted between skate wheel brackets 120 so that there exists a space between the top of the skate wheel 115 and the bottom of skate board 119 which is sufficient to allow cable 143 to pass through without riding on the skate wheel.

Cable Pulley Assembly

Mounted on the front and rear ends 130 of the frame 91 are four cable pulley assemblies 98. One cable pulley assembly 98 is mounted so that the side of the cable pulley 116 on which the cable 143 rides is in line with the center line of the track assembly 92 and on the front end 130 of the frame 91. Another cable pulley assembly 98 is mounted on the rear frame end 130 so that the side of the cable pulley 116 on which the cable 143 rides will be in line with the center line on the same track assembly 92 and, therefore, in line with the side of the cable pulley 116 on which the cable 143 rides which is mounted on the front frame end 130. In like manner, cable pulley assemblies 98 are mounted in tandem on the front and rear ends 130 of the frame 91 in conjunction with the other track assembly 92. Each of the cable pulley assemblies 98 are mounted above the respective frame end 130, at a height which will allow the cable 143 passing over the cable pulley 116 to contact the bottom of the skate board 119. The cable pulley assembly 98 consists of a cable pulley support 133 which is welded to the frame 91, the cable pulley 116 which is mounted in the support 133 on a cable pulley shaft 137 which passes through the cable pulley 116 and the cable pulley support 133. Cable pulley shaft 137 is affixed to the cable pulley support 133 by cable pulley end caps 135 which are snap rings with an end cover. All cable pulley assemblies 98 are identical in design.

Drag Assembly

The drag assembly 96 is mounted on the drag assembly mounting stub 117 by drag assembly threaded stud 118 which also provides an axle around which the drag assembly 96 rotates. The end of drag assembly threaded stud 118 is threaded so that drag knob 122 can be matingly engaged with the stud 118 thereby holding the drag assembly 96 together. In addition to the knob 122, the stud 118, and the stub 117; the drag assembly 96 comprises the drag spring 123, the drag needle bearing 124 with race washers 128 above and below the needle bearing 124, disk core 142 which is sandwiched between two disks 141, and the two drag pads 125. All of the parts are concentrically mounted on the stud 118 as illustrated in FIG. 8. After the ends of cable 143 are threaded through the core hole 155, the core 142 is fixed between disks 141 by mounting screws 140 so that there is no angular rotation of the core 142 relative to the disks 141. Needle bearing 124 allows knob 122 to be threaded downward on stud 118 to a considerable degree so that the lower disk 141 is pressed ever more firmly against drag pads 125 as knob 122 continues to be tightened without the bottom of the knob 122 causing any friction between it and top disk 141. The needle bearing 112 allows the top disk 141 to rotate around the bottom of knob 122 almost regardless of the degree to which knob 122 is tightened down on stud 118. On the other hand, drag pads 125 cause an increasingly greater amount of friction to exist between lower disk 141 and the drag pads 125 as knob 122 continues to be tightened on stud 118.

Cable

Cable 143 appears to be a continuous cable as shown in FIG. 1. However, the cable 143 is comprised of two sections of aircraft control cable which are threaded through each of the skate assemblies 94, the cable pulley assemblies 98 and around the disk core 142 of the drag assembly 96 with attachment points on the bottom of each skate board 119 forming a closed loop. The cable 143 is threaded by placing each of the skate assemblies 94 on their respective track assemblies 92 with the skate wheels 115 on the neoprene track 101 between the track tubes 102. It should be mentioned that the length of skate wheels 115 is nearly equivalent to the distance between the track tubes 102. The track tubes 102 thereby provide close guidance of the skate assemblies 94 along the length of the track assembly 92. With the longitudinal center of the skate assembly 94 in line with the frame middle brace 131, one end of a cable 143 section is attached to the bottom side of the skate board 119 with a conventional cable fastener. The cable 143 is threaded between the skate wheel 115 and the skate board 119 and is directed along the track assembly 92 toward the front end 130 of the frame 91. The cable 143 is then threaded between the pulley wheel 116 and pulley support 133. From there it is threaded through top core hole 155, out bottom core hole 155, and around the disk core 142 four to five times. The cable is wrapped around the disk core 142 four or five times so that under the maximum load, the cable 143 will not slip on the disk core 142. After leaving the disk core 142, the cable 143 is threaded through the other cable pulley assembly 98 by placing it between the pulley 116 and the support 133. With the other skate assembly 94 placed similarly to the first skate assembly 94, the cable 143 is threaded between the skate board 119 and the skate wheel 115 and is attached to the bottom of the skate board 119 in a manner similar to the attachment as previously mentioned. The second piece of aircraft control cable is attached at the same point on the skate assembly and in the same manner as previously mentioned and threaded out the back of the skate assembly 94 between the skate wheel 115 and the skate board 119 and down the length of the track assembly 92 through the rear cable pulley assembly 98 which is aligned with the track assembly 92 on which the last mentioned skate assembly 94 is located. From that cable pulley assembly 98 the cable 143 is threaded through the remaining cable pulley assembly 98 in like manner and down the track assembly 92 through the space between the skate wheel 115 and the skate board 119 of the second skate assembly 94 and connected to a conventional turnbuckle. The turn-buckle in turn is connected to original attachment point of the cable 143 first mentioned. The cable is of such a length that after it is attached in what now appears to be a continuous length of cable 143 when viewed from the perspective shown in FIG. 1, there is very little slack remaining. The little slack that does remain is taken up by tightening the turn-buckle on the bottom of the skate assembly 94. The cable 143 need not be under great tension but needs to be tight enough that it runs level from point to point without any sagging.

Vertical Poles

Front vertical poles 107 are placed in frame upright tubes 134 near the drag assembly 96. Both the front 107 and rear 108 vertical poles are of an outside diameter which will allow them to easily slip into the open-ended frame upright tubes 134 and yet remain perfectly upright. Each vertical pole 107, 108 is fitted with a plastic end cap 126. The rear vertical poles 108 are shorter than the front vertical poles 107, but are otherwise identical in construction, design, size, and purpose.

Side Rails

The side rails 114 are mounted on each side of the frame 91 between the front vertical pole 107 and the rear vertical pole 108. The side rails 114 are mounted so that they can be adjusted up and down upon each of the four vertical poles 107, 108.

Since the angle at which the side rails 114 meet the vertical poles 107, 108 is changed by raising or lowering the side rails 114 on the rear vertical poles 108 relative to the front vertical poles 107, rear pole bracket 97 allows the side rails 114 to move longitudinally in relation to the rear vertical poles 108 to account for the changes in length of the side rails 114 between the rear and front vertical poles 107, 108 as the angle of the side rail 114 with the front vertical pole 107 changes.

Figure 2:
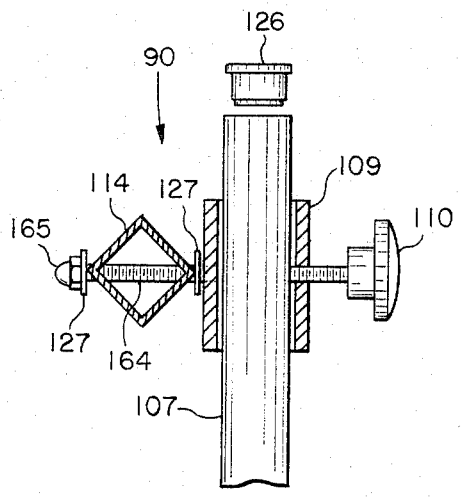
FIG. 2 is a cross-sectional view of a front pole bracket.

The side rails 114 are constructed of metal square hollow tubing. The side rails 114 are mounted upon the vertical poles 107, 108 so that a corner of the square tube points downward. The front of the side rail 114 is attached to the front vertical pole 107 by front pole bracket 90 as shown in FIG. 2. The front pole bracket 90 is comprised of a sleeve 109 which fits over the vertical pole 107, rod 164 which is threaded and welded to the sleeve 109. The rod 164 extends through a hole drilled through the side rail 114 on the diagonal. Washers 127 are on either side of the side rail 114 to allow free movement around the rod 164. Acorn nut 165 is threaded onto the end of rod 164 to maintain the side rail 114 in place. Knob and threaded stud combination 110 extend through a hole through the sleeve 109 on the side opposite the rod 164. The hole in sleeve 109 is threaded to engage with the knob and stud 110. The knob and stud 110 are screwed down against the vertical pole 107 to maintain the height adjustment of the side rail 114.

Figure 3:
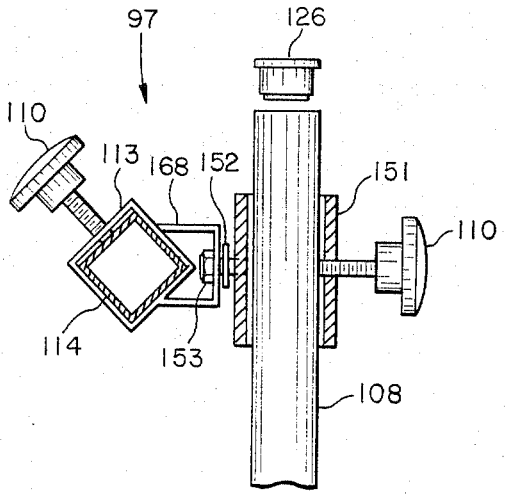
FIG. 3 is a cross-sectional view of a rear pole bracket.

Rear pole bracket 97 as shown in FIG. 3 supports the rear of the side rail 114. The rear pole bracket is comprised of rear pole bracket sleeve 151 which fits over the vertical poles 108 and knob and threaded stud combination 110 which is threadably engaged through a hole in the sleeve 151 for compression of the sleeve 151 against the vertical pole 108. Rear rail bracket 168 is bolted to pole bracket sleeve 151 with a nut and bolt combination 153 with a washer 152 between the rear rail bracket 168 and the sleeve 151. Side rail sleeve 113 is welded to rear rail bracket 168. Side rail sleeve 113 is mounted on the diagonal to receive the diagonally mounted side rail 114. In like manner as previously stated, knob and threaded stud combination 110 is used to adjustably affix the side rail sleeve 113 to the side rail 114 by compression.

Pole Carriage Assembly

Figure 4:
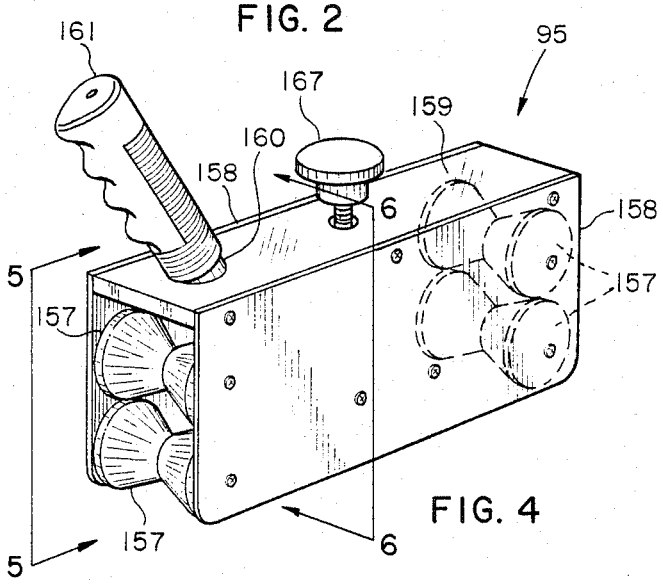
FIG. 4 is a perspective view of a pole carriage assembly.
Figure 5:
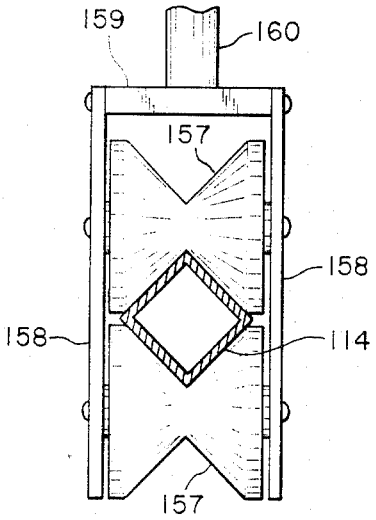
FIG. 5 is an end view of a pole carriage assembly along line 5—5 of FIG. 4 showing in cross-section, a side rail inserted between the pole carriage wheels.
Figure 6:
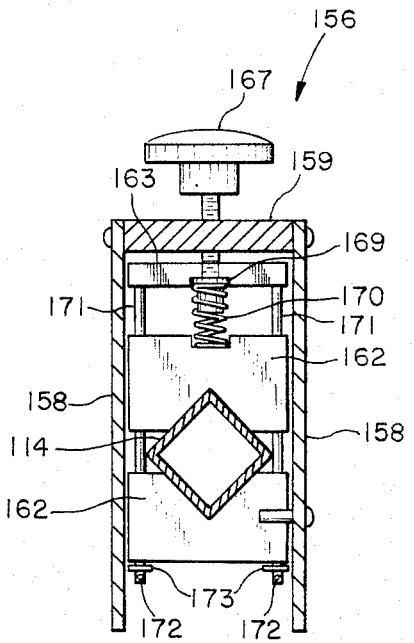
FIG. 6 is a partial cross-sectional view of the pole carriage assembly along line 6—6 of FIG. 4 showing the floating brake which is internal to the pole carriage assembly with a cross-section of a side rail inserted between the brake blocks.
Figure 7:
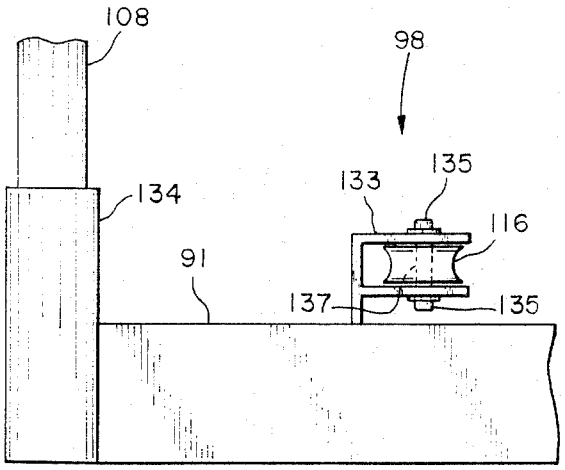
FIG. 7 is a partial view of the frame illustrating a typical cable pulley assembly of which there are four.

Each pole carriage assembly 95 is mounted on its respective side rail 114 so that it can slide along the length of the side rail 114. A floating brake 156 which is mounted internally in the pole carriage assembly 95 can be adjusted to provide varying amounts of resistance to slidable movement along the side rail 114. The pole carriage assembly 95 is shown in FIG. 4 in perspective and in an end view in FIG. 5 taken along line 5—5 of FIG. 4. The side plates 158 in conjunction with top plate 159 comprise the basic framework of the pole carriage assembly 95. Two sets of pole carriage wheels 157 are mounted at each end of the pole carriage assembly 95. Each set of pole carriage wheels 157 consist of two wheels 157 mounted one above the other. The pole carriage wheels 157 are made of ultra high molecular weight plastic or other similar low friction material. The pole carriage wheels 157 have a V-groove milled out of the center of the wheels 157, a shape which conforms to the V-shape of the upper and lower portions of the side rails 114. The fit between the upper and lower wheels 157 and the side rails 114 is close but allows for a small amount of play. During forward movement, pressure is pushed down on the pole carriage assembly 95 and the front upper wheel 157 and rear lower wheel 157 tend to rotate along the side rail 114. As the pole carriage assembly 95 is pulled backward on the side rail 114 an upward pressure is exerted on the pole carriage assembly 95 and the front lower wheel 157 and the rear upper wheel 157 tend to rotate. A pole handle 160 is mounted on the top plate 159 of the pole carriage assembly 95 by welding or other suitable means. For comfort, a grip 161 similar to a grip used on a bicycle is placed over pole handle 160. Each of the wheels 157 is rotatably mounted on an axle, which axle is affixed to each side plate 158 of pole carriage assembly 95.

Floating Brake

A floating brake 156 is internal to the pole carriage assembly 95. Part of the floating brake 156 consists of two nylon brake blocks 162. The nylon brake blocks 162 each have a V-groove cut into their center. The V-groove is sized to fit over the diagonal end of the side rail 114. The brake blocks 162 ride on the side rail 114 so that one of the brake blocks 162 is riding on the top of the side rail 114 and the other brake block 162 is riding on the bottom of the side rail 114. The brake blocks 162 are manufactured of a ultra high molecular weight plastic for wear resistant purposes and also because the material has a very low coefficient of friction. To increase the resistance of the pole carriage assembly 95 to slidable movement along the side rail 114, pressure is exerted on both of the brake blocks 162 to squeeze the side rail 114 between the brake blocks 162. As the squeezing is increased, the resistance of the pole carriage assembly 95 to slidable movement along the side rail 114, is increased.

The brake blocks 162 are located within the pole carriage assembly 95. The V-groove of the brake blocks 162 is in line with the side rail 114. The alignment of the side rail 114 is determined by the two sets of pole carriage wheels 157 which are located in the forward part of the pole carriage assembly 95 and the rear part of the pole carriage assembly 95. The brake blocks 162 are held in alignment by two brake rods 171 which extend through each of brake blocks 162. The brake rods 171 are inserted through axially aligned holes in the corners of the brake blocks 162. The brake rods 171 are held in place at the bottom of the bottom brake block 162 by washer 173 and a pin 172 which extends through a diameter of the brake rod 171. The brake pins 172 extend through the bottom brake block 162, through the top brake block 162, and into a brake plate 163 which is mounted above the top brake block 162. The brake pins 171 are fixedly mounted to the brake block 162 thereby forming a fixed assembly consisting of the brake plate 163 with two brake blocks 162 mounted above one another with V-grooves in line so that each brake block 162 is free to slide in an up and down motion upon the two brake rods 171.

Between the brake plate 163 and the top brake block 162 is mounted a spiral spring 170. The spiral spring 170 is mounted at the center of the upper brake block 162. The spring peg 169 is seated in top of the spiral spring 170. Brake knob 167 and its associated threaded stud extends through the pole carriage top plate 159 of the pole carriage assembly 95. The hole through which it extends is greater than the diameter of the threaded stud of the brake knob 167. The threaded stud of brake knob 167 is threaded into a threaded hole of the brake plate 163 and contacts the spring peg 169. As the threaded stud of brake knob 167 is threaded into the brake plate 163, it compresses the spiral spring 170 which forces the top brake block down upon side rail 114 which in turn forces the bottom of the side rail 114 into the V-groove of the bottom brake block 162 which in turn forces the bottom brake block 162 against the washers 173. All this results in a squeezing of the side rail 114 between the V-grooves of the upper and lower brake blocks 162. As the brake knob is increasingly tightened, the brake blocks 162 squeeze the side rail 114 in an increasing amount thereby making sliding movement of the pole carriage more difficult.

OPERATION OF THE PREFERRED EMBODIMENT

The cardiovascular exercise machine 88 is designed to provide the maximum degree of exercise of the cardiovascular system by simulating a cross-country ski motion with the addition of the requirement of leg and arm pressure in the forward direction as well as the backward direction. To utilize the cardiovascular exercise machine 88, a user stands between the side rails 114 and places his feet on each of the skate assemblies 94. The user grasps the pole handle grips 161 with each of his hands. The user then forces one skate assembly 94 forward with his foot. As the skate assembly 94 travels forward on the track assembly 92, the other skate assembly 94 must move in a backward direction because the skate assemblies 94 are affixed to a continuous-like cable 143 at fixed predetermined points. Therefore, if one skate assembly 94 moves forward, the other skate assembly 94 must move backward and vice versa. When the drag assembly knob 122 is screwed out to the maximum extent, there is virtually no resistance to the movement of the skate assemblies 94 because the skate wheels 115 and the neoprene track 101 provide almost frictionless movement of the skate assemblies 94 over the neoprene track 101. To increase the workload on the user, the drag assembly knob 122 must be screwed inwardly to increase the drag of the drag pads 125 against the bottom disk 141 of the drag assembly 96. Since the cable 143 is wound around the disk core 142 four or five turns to avoid the possibility of cable 143 slippage on the disk core 142, the user must work harder to move the drag assembly 96 in a circular motion against the drag pads 125. The drag created requires the user to exert increased amounts of energy to maintain the forward and backward motion of the skate assemblies 94.

To further simulate the cross-country ski exercise motions which are so beneficial to the exercise of the cardiovascular system, the pole carriage assemblies 95 are designed to simulate the use of ski poles during the cross-country skiing experience. The side rails 114 are adjustable upwards or downwards to suit the height requirements of the particular user. In a like fashion with the skate assemblies 94, the workload on the arms of the user can be increased by increasing the pressure that floating brake 156 exerts on the side rail 114. A simple adjustment of the brake knob 167 will increase the drag of the pole carriage assembly 95 on the side rail 114. The user then coordinates the alternating forward and backward motions of the arms with the alternating forward and backwards motions of the legs as would be done in an actual cross-country skiing experience. The height of the front of the side rail 114 is adjusted so that it is higher than the height of the back of the side rail 114 so that it more nearly simulates the actual experience of cross-country skiing. As a cross-country skier places his poles in the snow and pushes forward, the wrists of the cross-country skier go from a position near the shoulder to a position near the skier's buttocks. The differential in the height of the front and rear of the side rail 114 simulates this varying height of the wrists. The ability to adjust this differential or angle of the side rails also allows the user to make an adjustment simply to suit his comfort needs.

The ability to change the drag on the pole carriage assemblies independent of drag on the skate assemblies allows a user to exercise his legs to a greater or lesser degree than his arms. The ability to change the drag on one pole carriage assembly independently of the other pole carriage assembly allows a user to exercise one arm to a greater extent than the other.

I have disclosed a preferred embodiment description and application of the invention. Other modifications of the invention which are not specifically disclosed or referred to will be apparent to those skilled in the art in light of the foregoing description. This description is intended to provide a concrete example of the preferred embodiment structure and application, clearly disclosing the present invention and its operative principals. Accordingly, the invention is not limited to any particular embodiment or configurations and variations of the present invention which fall within the spirit and broad scope of the appended claims are covered.

What is claimed is:

1. A cardiovascular exercise machine comprising:

(a) a frame on which is mounted two track assemblies;

(b) two skate assemblies each of which is slidably mounted on a track assembly and which skate assembly is interconnected by a cable in a closed loop; and (c) two side rails affixed to the frame on each of which is slidably mounted a pole carriage assembly, the pole carriage assembly having a means for providing an adjustable constant drag force throughout its travel during both forward and backward movement.

2. The cardiovascular exercise machine of claim 1 also comprising a drag assembly around which is wound the cable to provide drag on the cable.

3. The cardiovascular exercise machine of claim 1 whereby the means for providing a constant drag force by the pole carriage assembly is comprised of two floating brakes mounted internally to each of the pole carriage assemblies whereby drag is provided against movement of the pole carriage assembly on the side rail.

4. The drag assembly of claim 2 comprising:

(a) a lower disk and an upper disk, the lower disk seated against one or more drag pads;

(b) a disk core sandwiched between the lower and upper disk and fixedly mounted to each disk, the disks and the core each having an axially aligned hole through their centers;

(c) a needle bearing with upper and lower race washers mounted above the upper disk; and (d) a spiral spring mounted above the upper race washer and a knob threadable mounted above the spiral spring on a threaded stud which extends upwardly from a drag assembly stub on which the drag pads are mounted through the lower disk, the disk core, the upper disk, the race washers and needle bearing, the spring, and into the threaded knob so that by tightening the threaded knob on the threaded stud the lower disk is increasingly forced against the drag pads thereby increasing the drag on angular movement of the drag assembly.

5. The drag assembly of claim 4 wherein the drag disk has a hole passing from the top of the drag disk to the bottom to allow the passage of a cable.

6. The cardiovascular exercise machine of claim 1 wherein the pole carriage assembly comprises:

(a) a top plate mounted between two side plates;

(b) a pole handle mounted on the top plate; and (c) two sets of rotatably mounted pole carriage wheels each set having a wheel mounted above the other wheel, each wheel being grooved to accommodate a diagonally positioned side rail between the set of wheels, one set of wheels placed at the front of the pole carriage assembly and the other at the rear so that the diamond shaped spaces formed by each opposed set of wheels are in axial alignment thereby allowing for slidable movement of the pole carriages on the side rails.

7. The cardiovascular exercise machine of claim 1 wherein the drag means is mounted internally to each pole carriage assembly between each set of wheels and comprises:

(a) two brake blocks mounted above and below the diagonally positioned side rail, each brake block having a V-groove in the surface engaging the side rail of a size which mates with the diagonally positioned side rail;

(b) a brake plate mounted above the upper brake block and connected to the upper and lower brake blocks by two or more brake pins thereby maintaining the relative transverse positions of the plate and two brake blocks constant while allowing up and down movement of the brake blocks on the pins;

(c) a spring between the upper brake block and the brake plate; and (d) a threaded shaft with a knob for threadable engagement with a threaded hole through the brake plate, the threaded hole being positioned above the spring, thereby increasing the drag on a side rail by allowing the brake blocks to be squeezed together against a side rail placed between them by turning the knob.

8. The cardiovascular exercise machine of claim 1, wherein the track assembly comprises:

(a) a wooden track of a length which extends from the front end of the frame to the rear end of the frame;

(b) two neoprene tracks mounted on the wooden track a distance apart equivalent to the distance apart that a normal person would maintain his feet apart during walking and each neoprene track extending from the front of the frame to the rear of the frame, each neoprene track being of a width at least equivalent to the width of the skate wheel of a skate assembly; and (c) four track tubes attached to the track assembly and extending from the front of the frame to the rear of the frame forming two parallel sets of track tubes each set of tubes having a spaced parallel distance between its respective two tubes approximately equal to the length of a skate wheel thereby providing guidance of the skate assembly along the longitudinal direction of the track assembly.

* * * * *